US005168210A

United States Patent [19]

Thus

[11] Patent Number: 5,168,210

[45] Date of Patent: Dec. 1, 1992

[54] BAND-GAP REFERENCE CIRCUIT

[75] Inventor: Franciscus J. M. Thus, Eindhoven, Netherlands

[73] Assignee: U.S. Philips Corp., New York, N.Y.

[21] Appl. No.: 789,375

[22] Filed: Nov. 1, 1991

[30] Foreign Application Priority Data

Nov. 2, 1990 [NL] Netherlands ..... 9002392

[51] Int. Cl.[5] ..... G05F 3/30

[52] U.S. Cl. ..... 323/313; 307/296.1; 307/296.6

[58] Field of Search ..... 323/312, 313, 314, 315, 323/907; 307/296.1, 296.6, 296.7

[56] References Cited

U.S. PATENT DOCUMENTS

| | | | |
|---|---|---|---|
| 4,249,122 | 2/1981 | Widlar | 323/313 |
| 4,380,728 | 4/1983 | Kearney | 323/313 X |
| 4,590,418 | 5/1986 | Moriarty, Jr. | 323/313 |
| 4,590,419 | 5/1986 | Moriarty, Jr. | 323/313 |
| 4,675,593 | 6/1987 | Minakuchi | 323/314 |
| 4,833,344 | 5/1989 | Moon et al. | 323/315 X |
| 5,053,640 | 10/1991 | Yum | 323/313 X |

*Primary Examiner*—Emanuel T. Voeltz
*Attorney, Agent, or Firm*—Steven R. Biren

[57] ABSTRACT

For the generation of a junction voltage with a negative temperature coefficient, a band gap reference circuit includes a first semiconductor element (T) and a voltage divider (R3, R4) adapted to generate a measure of the junction voltage across a main current path of a second semiconductor element (T5), a current source (J1) being adapted to generate a reference current with a positive temperature coefficient by means of a resistive element (R1) coupled in series with the main current path. Since the reference current generates a compensation voltage with a positive temperature coefficient across the resistive element (R1) the sum of the measure of the junction voltage and the compensation voltage yields a reference voltage with a specific temperature coefficient, the presence of the voltage divider (R3, R4) inter alia enabling a reference voltage with a temperature coefficient of zero volts per temperature unit to be obtained at comparatively low supply voltages.

8 Claims, 1 Drawing Sheet

BAND-GAP REFERENCE CIRCUIT

BACKGROUND OF THE INVENTION

The invention relates to a band-gap reference circuit for generating a reference voltage with a specific temperature coefficient, the circuit comprising a first semiconductor element having at least one junction for generating a junction voltage with a negative temperature coefficient, which first semiconductor element is coupled between a first and a second supply voltage terminal, a current source for generating a reference current with a positive temperature coefficient, which current source is coupled between the second supply voltage terminal and an output terminal, and a resistive element for carrying at least a measure of the reference current, which resistive element is coupled between the output terminal and the first supply voltage terminal.

Such a band-gap reference circuit can be used in general for the generation of a reference voltage in integrated semiconductor circuits, the reference voltage being available for example between the output terminal and the first supply voltage terminal.

Such a band-gap reference circuit is known from FIG. 4.1 of the dissertation entitled "Integrated Circuits and Components for Band Gap References and Temperature Transducers", written by G. C. M. Meijer and published on Mar. 19, 1982 at Delft (Netherlands). The known band-gap reference circuit comprises the first semiconductor element constructed by means of a first transistor, the resistive element constructed by means of a resistor, and the current source constructed by means of a second transistor, the first transistor being coupled as a diode, and the first transistor, the resistor and the second resistor being coupled in series between the first and the second supply voltage terminal. In the band-gap reference circuit which is constructed and coupled in this way the junction voltage generated across the junction of the first semiconductor element corresponds to a base-emitter voltage generated by the first transistor, and the reference current generated by the current source corresponds to a main current in the second transistor, the base-emitter voltage having the negative temperature coefficient and the main current having the positive temperature coefficient. Since the first transistor, the resistor and the second transistor are coupled in series at least a measure of the main current with the positive temperature coefficient in the second transistor flows both through the first transistor and the resistor. In spite of this, the base-emitter voltage of the first transistor retains a negative temperature coefficient, while the resistor receives a compensation voltage with a positive temperature coefficient, the reference voltage generated by the band-gap reference circuit between the output terminal and the first supply voltage terminal being equal to the sum of the base-emitter voltage and the compensation voltage. As a result of this, the temperature coefficient of the reference voltage is determined by the negative temperature coefficient of the base-emitter voltage and the positive temperature coefficient of the compensation voltage, which temperature coefficients depend upon parameters and the dimensioning of the band-gap reference circuit.

A disadvantage of the known band-gap reference circuit is the supply voltage which it requires. For example, if a reference voltage with a temperature coefficient of substantially zero volts per temperature unit is desired the sum of the base-emitter voltage and the compensation voltage is dictated mainly by a band-gap voltage contained in the base-emitter voltage, which band-gap voltage is a physical constant and is 1.205 V in the case of silicon. Consequently, in the afore-mentioned case the required supply voltage, i.e. at least one saturation voltage as a result of the second transistor plus the sum of the compensation voltage and the base-emitter voltage, is larger than the voltage supplied by a standard button cell (1.2 V), which prohibits the use of the band-gap reference circuit in some circuit arrangements requiring a comparatively low supply voltage, such as for example hearing-aid circuits.

SUMMARY OF THE INVENTION

It is an object of the invention to provide a band-gap reference circuit which in the case of comparatively low supply voltages is inter alia capable of generating a reference voltage with a temperature coefficient of substantially zero volts per temperature unit.

A band-gap reference circuit in accordance with the invention is characterized in that the band-gap reference circuit further comprises a second semiconductor element and a voltage divider, which second semiconductor element has a main current path coupled between the first supply voltage terminal and the output terminal, in series with the resistive element, and which voltage divider is adapted to generate a measure of the junction voltage across the main current path of the second semiconductor element.

In the band-gap reference circuit in accordance with the invention the reference voltage with the given temperature coefficient is determined by the sum of the measure of the junction voltage, which measure has a negative temperature coefficient, and the compensation voltage across the resistive element, which compensation voltage has a positive temperature coefficient, the measure containing only a specific portion of the junction voltage generated by the first semiconductor element, which portion is determined by the voltage divider. Consequently, inter alia the reference voltage with the temperature coefficient of zero volts per temperature unit can be generated already at comparatively low supply voltages, for which supply voltages the first semiconductor element, for the purpose of generating the junction voltage, can be coupled between the first and the second supply voltage terminal, for example by means of a resistor coupled in series with the junction.

A first embodiment of a band-gap reference circuit in accordance with the invention may be characterized in that the second semiconductor element further has a control electrode coupled to a point situated between the first semiconductor element and the second supply voltage terminal. As a result of this, the second semiconductor element, which may be for example a unipolar or a bipolar transistor, receives a control voltage equal to the junction voltage generated by the first semiconductor element, which does not require an increase of the supply voltage.

A second embodiment of a band-gap reference circuit in accordance with the invention may be characterized in that the voltage divider comprises a series arrangement of at least two resistors, which series arrangement is coupled in parallel with the junction, one of the two resistors being coupled in parallel with the main current path of the second semiconductor element. Since the two resistors are coupled in parallel with the junction of the first semiconductor element the junction voltage is converted into a current flowing through the two resistors, which current generates across one of the two resistors the measure of the junction voltage, the measure being also generated across the main current path of the second semiconductor element, which main current path is coupled to one of the two resistors.

A third embodiment of a band-gap reference circuit in accordance with the invention may be characterized in that the first semiconductor element comprises a unidirectional element, which element is coupled to the second supply voltage terminal by means of a further current source. The further current source supplies to the unidirectional element a specific current, which generates across said element the junction voltage, only one saturation voltage being required across the further current source, which does not require an increase of the supply voltage.

A fourth embodiment of a band-gap reference circuit in accordance with the invention may be characterized in that the first semiconductor element, the current source and the further current source form part of a PTAT current-source circuit. This embodiment leads to a very compact construction of the band-gap reference circuit in accordance with the invention, which embodiment may be characterized further in that the PTAT current source circuit comprises a first, a second, a third and a fourth transistor, each having a base, a collector and an emitter, and a further resistor, the emitter of the first transistor being coupled to the first supply voltage terminal by means of the further resistor, the base of the first transistor being coupled to the point situated between the first semiconductor element and the second supply voltage terminal and to the base of the second transistor, whose emitter is coupled to the first supply voltage terminal, the collector of the first transistor being coupled to a control electrode of the further current source and to the collector of the third transistor, whose emitter like the emitter of the fourth transistor is coupled to the second supply voltage terminal and whose base is coupled to the mutually coupled base and collector of the fourth transistor and to the collector of the second transistor.

A fifth embodiment of a band-gap reference circuit in accordance with the invention may be characterized in that the current source and the resistive element are coupled to the output terminal by means of a buffer circuit. The addition of the buffer circuit reduces the influence of a load coupled to the output terminal of the band-gap reference circuit. The present embodiment may be characterized further in that the buffer circuit comprises a differential pair having a first input coupled to the current source and the resistive element, having a second input coupled to the output terminal, having a common terminal coupled to the first supply voltage terminal by means of a tail current source, having a first output coupled both to the second supply voltage terminal by means of a load element and to a control electrode of an output transistor which has a main current path coupled between the second supply voltage terminal and the output terminal, and having a second output coupled to the second supply voltage terminal. The band-gap reference circuit of this construction enables a comparatively large current to be obtained without any undesirable consequences as a result of a load.

BRIEF DESCRIPTION OF THE DRAWING

These and other (more detailed) aspects of the invention will be described more comprehensively with reference to the accompanying drawing, in which.

In these Figures like parts bear the same reference numerals.

DESCRIPTION OF THE PREFERRED EMBODIMENTS

Figure 1:
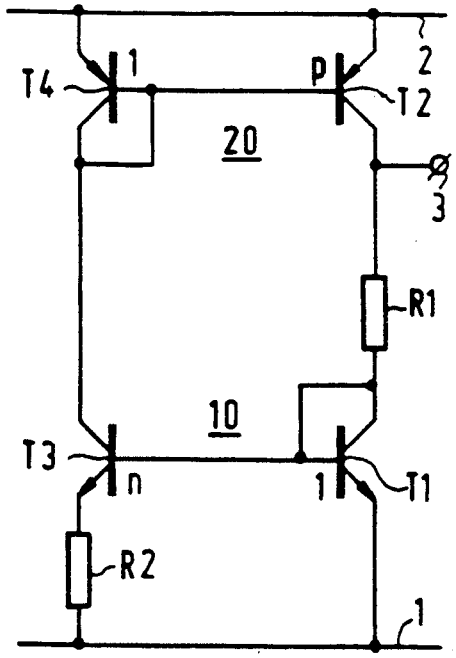
FIG.1 PRIOR ART
FIG. 1 shows a prior-art band-gap reference circuit.

FIG. 1 shows a prior-art band-gap reference circuit, which circuit corresponds to that shown in FIG. 4.1 of the dissertation cited hereinbefore. The circuit comprises a first semiconductor element, which is realized by means of a transistor T1 and which forms part of a PTAT current-source circuit 10, a resistive element in the form of a resistor R1, and a current source constructed by means of a transistor T2 and forming part of a current-mirror circuit 20. The PTAT current-source circuit 10 comprises, in addition to the transistor T1, a resistor R2 and a transistor T3, while the current-source circuit 20 comprises a transistor T4 in addition to the transistor T2, each of the transistors T1, T2, T3 and T4 having a base, a collector and an emitter. The transistor T1 has its base and its collector coupled to each other, so that the transistor T1 forms a diode. Moreover, the base and the collector of the transistor T1 are coupled to an output terminal 3 by means of the resistor R1, and to the base of the transistor T3. The emitters of the transistors T1 and T3 are coupled to a first supply voltage terminal 1, the resistor R2 being coupled between the emitter of the transistor T3 and the supply voltage terminal 1 and the emitter of the transistor T3 having an emitter area which is n times as large as that of the transistor T1. The base of the transistor T2 is coupled both to the base and the collector of the transistor T4, so that the transistor T4 also constitutes a diode. The emitters of the transistors T2 and T4 are coupled to a second supply voltage terminal 2, the emitter of the transistor T2 having an emitter area which is p times as large as that of the transistor T4. The collector of the transistor T2 is coupled to the output terminal 3, and the collector of the transistor T4 is coupled to the collector of the transistor T3. In the band-gap reference circuit which is constructed and coupled in this way a reference current generated by the current source corresponds to a main current in the transistor T2, at least a measure of the main current flowing both through the resistor R1 and the transistor T1, and a junction voltage generated across a junction of the first semiconductor element corresponds to a base-emitter voltage generated across the base and the emitter of the diode-connected transistor T1 by the main current. Since the base of the transistor T1 is coupled to the base of the transistor T3 and the emitters of the transistors T1 and T3 are coupled via the supply voltage terminal 1 and the resistor R2 a voltage equal to the difference between the base-emitter voltage of the transistor T1 and the base-emitter voltage of the transistor T3 is obtained across the resistor R2, which resistor R2, as is generally known, converts the resulting voltage into a PTAT current with a positive temperature coefficient. Since the PTAT current is taken from the diode-connected transistor T4 via the transistor T3, which transistor T4 together with the transistor T2 forms the current-mirror circuit 20, the main current in the transistor T2 also has a positive temperature coefficient. The prior-art band-gap reference circuit generates a reference voltage with a specific temperature coefficient on the basis of the main current with the positive temperature coefficient, which main current produces a compensation voltage with a positive temperature coefficient across the resistor R1, and on the basis of the base-emitter voltage of the transistor T1, which base-emitter voltage has a negative temperature coefficient. The generated reference voltage is available, for example, between the output terminal 3 and the supply voltage terminal 1, the reference voltage being equal to the sum of the compensation voltage and the base-emitter voltage and the temperature coefficient of the reference voltage being determined by the positive temperature coefficient of the compensation voltage and the negative temperature coefficient of the base-emitter voltage. The two last-mentioned temperature coefficients are dependent upon parameters and the dimensioning of the band-gap reference circuit. A drawback of the prior-art band-gap reference circuit is the supply voltage which it requires. In the case of, for example, a reference voltage with a temperature coefficient of substantially zero volts per temperature unit the sum of the compensation voltage and the base-emitter voltage is determined mainly by a band-gap voltage contained in the base-emitter voltage, which band-gap voltage is a physical constant and is 1.205 V in the case of silicon. Therefore, the required supply voltage in the above case, which is equal to at least one saturation voltage as a result of the transistor T2 plus the sum of the compensation voltage and the base-emitter voltage, is larger than the voltage supplied by a standard button cell (1.2 V), which prohibits the use of the band-gap reference circuit in some circuits requiring a comparatively low supply voltage. For more detailed information reference is made to the dissertation and to the second edition of the handbook by P. Gray and R. Meijer, entitled "Analysis and Design of Analog Integrated Circuits", which handbook starting from page 289 describes both a derivation and a computation of the reference voltage with a temperature coefficient of zero volts per temperature unit.

Figure 2:
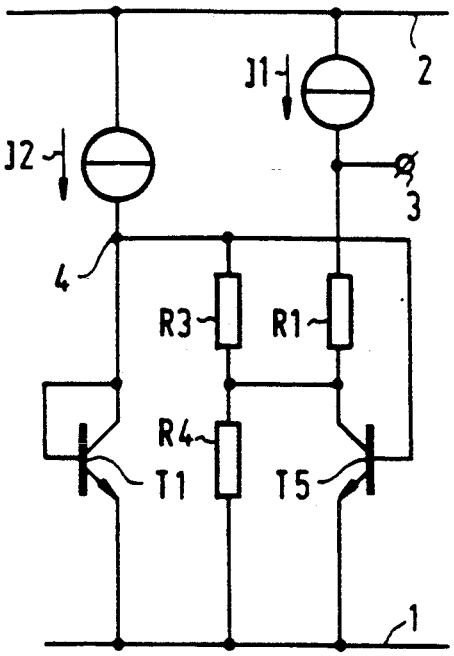
FIG. 2 shows an embodiment of a band-gap reference circuit in accordance with the invention.

FIG. 2 shows an embodiment of a band-gap reference circuit in accordance with the invention. The first semiconductor element and the resistive element are constructed by means of the transistor T1 and the resistor R1 in the same way as shown in FIG. 1, although the diode-connected transistor T1 is coupled between a terminal 4 and the supply voltage terminal 1. The current source, which is coupled between the supply voltage terminal 2 and the output terminal 3, is constructed by means of a current J1, which for the generation of the reference current with the positive temperature coefficient can be constructed in various known manners. A second semiconductor element is coupled in series with the resistor R1 between the output terminal 3 and the supply voltage terminal 1 and is constructed by means of a transistor T5 having its base coupled to the terminal 4 and having its main current path coupled between the resistor R1 and the supply voltage terminal 1. A voltage divider is coupled in parallel with the transistor T1 between the terminal 4 and the supply voltage terminal 1. The voltage divider comprises a resistor R3, which is coupled between the terminal 4 and a point situated between the resistor R1 and the main current path of the transistor T5, and a resistor R4, which is coupled between said point and the supply voltage terminal 1. In the band-gap reference circuit of this construction a first current source J2 supplies current to the diode-connected transistor T1, which results in a base-emitter voltage with a negative temperature coefficient across the transistor T1 which is coupled in parallel with the voltage divider. With respect to the voltage divider the resulting base-emitter voltage generates a current through both the resistor R3 and the resistor R4, a measure of the base-emitter voltage being generated across the resistor R4 which is coupled in parallel with the main current path of a transistor T5, the transistor T5 being driven by the base-emitter voltage. This also results in the measure of the base-emitter voltage appearing across the main current path of the transistor T5, which measure can be varied depending on the voltage divider and, in accordance with the invention, the reference voltage between the output terminal 3 and the supply voltage terminal 1 is dictated by the sum of the compensation voltage as a result of the reference current with the positive temperature coefficient through the resistor R1 and the measure of the base-emitter voltage across the main current path, the temperature coefficient of the reference voltage being dependent upon the positive temperature coefficient of the compensation voltage and the negative temperature coefficient of the measure. Since the compensation voltage depends on the reference current and the measure is variable, the minimum supply voltage required in accordance with the invention is determined by one saturation voltage as a result of the current source J2 plus the base-emitter voltage across the transistor T1, at which supply voltage it is possible inter alia to realize the reference voltage with the temperature coefficient of zero volts per temperature unit.

Figure 3:
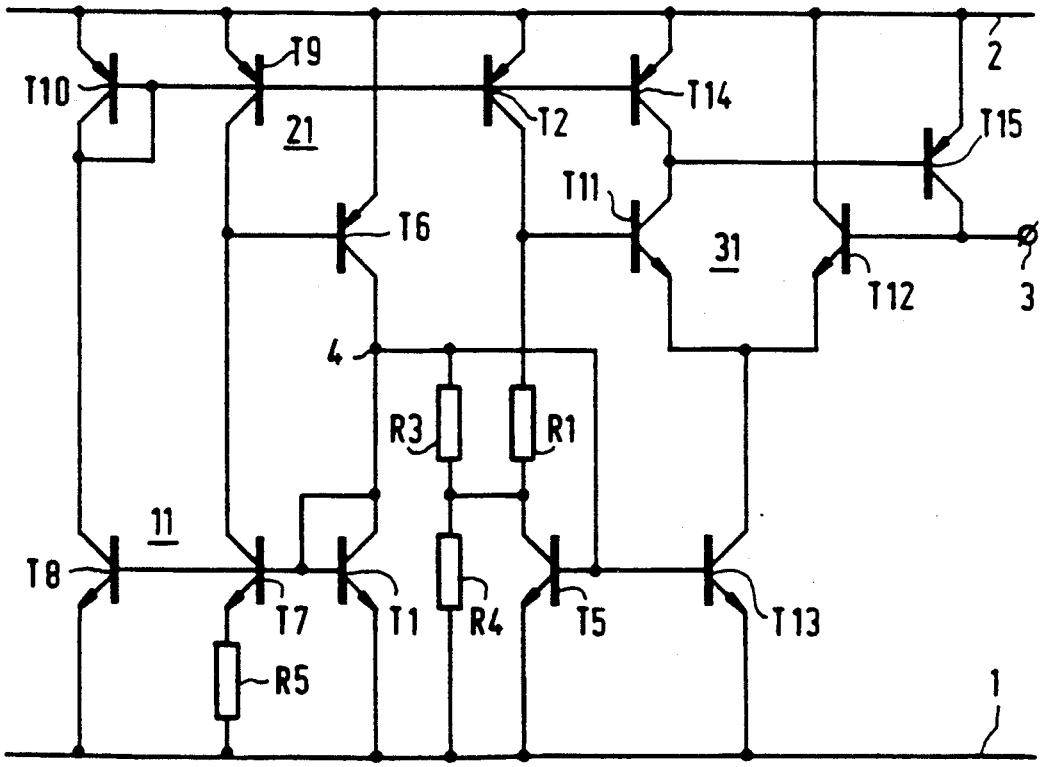
FIG. 3 shows a further embodiment of a band-gap reference circuit in accordance with the invention.

FIG. 3 shows a further embodiment of a band-gap reference circuit in accordance with the invention. The further embodiment differs from the embodiment shown in FIG. 2 in that a PTAT current-source circuit 11, a current-mirror circuit 21 and a buffer circuit 31 have been added, and in that the further current source is constructed by means of a transistor T6 having its base coupled to the current mirror circuit 21 and having its main current path coupled between the supply voltage terminal 2 and the terminal 4. The PTAT current source circuit comprises the first semiconductor element formed by means of the transistor T1, and a transistor T7, a transistor T8 and a resistor R5, which transistors may have differently scaled emitter areas. The current mirror circuit 21 comprises the current source formed by means of the transistor T2, and a transistor T9 and a transistor T10, which transistors may also have differently scaled emitter areas. The buffer circuit 31 comprises a differential pair formed by means of a transistor T11 and a transistor T12, a tail current source comprising a transistor T13, a load element comprising a transistor T14, and an output transistor T15. In the present embodiment each of these transistors has a base, a collector and an emitter, the base of the transistor T1 being coupled to the bases of the transistors T7 and T8. The emitters of the transistors T7 and T8 are each coupled to the supply voltage terminal 1, the resistor R5 being coupled between the emitter of the transistor T7 and the supply voltage terminal 1. The base of the transistor T2 is coupled both to the bases of the transistors T9 and T10 and to the collector of the transistor T10, so that the transistor T10 forms a diode. The emitters of the transistors T9 and T10 are each coupled to the supply voltage terminal 2, the collector of the transistor T9 being coupled both to the base of the transistor T6 and to the collector of the transistor T7 and the collector of the diode-connected transistor T10 being coupled to the collector of the transistor T8. Like the bases and the emitters of the transistors T9 and T10, the base and the emitter of the transistor T14 are also coupled to the base of the transistor T2 and the supply voltage terminal 2 respectively. The base of the transistor T11 is coupled both to the main current path of the transistor T2 and to the resistor R1, and the base of the transistor T12 is coupled to the output terminal 3, the emitters of the transistors T11 and T12 are each coupled to the collector of the transistor T13, whose base and emitter are coupled to the terminal 4 and the supply voltage terminal 1 respectively. The collector of the transistor T11 is coupled both to the collector of the transistor T14 and to the base of the transistor T15, whose collector and emitter are coupled to the supply voltage terminal 2 and the output terminal 3 respectively. The collector of the transistor T2 is also coupled to the supply voltage terminal 2. The band-gap reference circuit thus coupled constitutes only possibility of implementing the current source for generating the reference current with the positive temperature coefficient, the buffer circuit 31 reducing the influence of a load coupled to the output terminal 3 upon the circuit. In the buffer circuit 31 the transistors T11 and T12 ensure that the reference voltage between the output terminal 3 and the supply voltage terminal 1 is equal to the sum of the compensation voltage across the resistor R1 and the measure of the base-emitter voltage across the main current path of the transistor T5, the transistor T15 supplying a current to the output terminal 3. The transistors T13 and T14 provide a desired current setting in the buffer circuit 31, the transistor T13 being scalable with respect to the transistors T1, T5, T7, T8 and the transistor T14 being scalable with respect to the transistors T2, T9 and T10. For the operation of the PTAT current source circuit 11 and the current mirror circuit 21 reference is made to the description pertaining to FIG. 1, the transistors T7 and T10 and the resistor R5 corresponding to the transistors T3 and T4 and the resistor R2, and the transistors T8 and T9 providing a reduced load of the transistors T7 and T10 relative to the transistors T3 and T4. Moreover, the transistor T6 provides a supply of base current to the collector of the transistor T7, which supply in the case of a suitable dimensioning is equal to the supply of base currents to the collector of the transistor T8 provided by the transistors T2, T9, T10 and T14. An improved symmetry, and hence an improved performance, is also achieved in that neither the transistor T7 nor the transistor T8 are diode-connected, which transistors constitute the heart of the PTAT current source circuit 11. The present embodiment is a compact implementation of the band-gap reference circuit in accordance with the invention, which implementation owing to the combination of the PTAT current source circuit 11 and the current mirror circuit 21 is immune to supply voltage variations, and owing to the presence of the buffer circuit 31 is capable of supplying a comparatively large output current. In spite of this, the present embodiment already operates at comparatively low supply voltages, at which supply voltages it is possible inter alia to obtain the reference voltage with a temperature coefficient of zero volts per temperature unit owing to the use of the voltage divider.

The invention is not limited to the embodiments shown herein. Within the scope of the invention many modifications are conceivable to those skilled in the art. For example, in the case of a temperature-independent supply voltage the reference voltage can be taken off between the output terminal and the second supply voltage terminal. Moreover, it will be appreciated that the current source, including both the PTAT current source circuit and the current mirror circuit, the semiconductor elements, the voltage divider and the buffer circuit can be realised in various manners. Furthermore with respect to the transistors used in the embodiments it is to be noted that both transistors of an opposite conductivity type and transistors of another type, for example unipolar transistors, can be used.

I claim:

1. A band-gap reference circuit for generating a reference voltage with a specific temperature coefficient, the circuit comprising a first semiconductor element having at least one junction for generating a junction voltage with a negative temperature coefficient, which first semiconductor element is coupled between a first and a second supply voltage terminal, a current source for generating a reference current with a positive temperature coefficient, which current source is coupled between the second supply voltage terminal and an output terminal, and a resistive element for carrying at least a measure of the reference current, which resistive element is coupled between the output terminal and the first supply voltage terminal, characterized in that the band-gap reference circuit further comprises a second semiconductor element and a voltage divider, which second semiconductor element has a main current path coupled between the first supply voltage terminal and the output terminal, in series with the resistive element, which voltage divider comprises means for generating a measure of the junction voltage across the main current path of the second semiconductor element.

2. A band-gap reference circuit as claimed in claim 1, characterized in that the second semiconductor element further has a control electrode coupled to a point situated between the first semiconductor element and the second supply voltage terminal.

3. A band-gap reference circuit as claimed in claim 1, characterized in that the voltage divider comprises a series arrangement of at least two resistors, which series arrangement is coupled in parallel with the junction, one of the two resistors being coupled in parallel with the main current path of the second semiconductor element.

4. A band-gap reference circuit as claimed in claim 1, characterized in that the first semiconductor element comprises a unidirectional element, which element is coupled to the second supply voltage terminal by means of a further current source.

5. A band-gap reference circuit as claimed in claim 4, characterized in that the first semiconductor element, the current source and the further current source form part of a PTAT current source circuit.

6. A band-gap reference circuit as claimed in claim 5, characterized in that the PTAT current source comprises a first, a second, a third and a fourth transistor, each having a base, a collector and an emitter, and a further resistor, the emitter of the first transistor being coupled to the first supply voltage terminal by means of the further resistor, the base of the first transistor being coupled to the point situated between the first semiconductor element and the second supply voltage terminal and to the base of the second transistor, whose emitter is coupled to the first supply voltage terminal, the collector of the first transistor being coupled to a control electrode of the further current source and to the collector of the third transistor, the emitters of the third and fourth transistors being coupled to the second supply voltage terminal and the base of the third transistor being coupled to the mutually-coupled base and collector of the fourth transistor and to the collector of the second transistor.

7. A band-gap reference circuit as claimed in claim 1 characterized in that the current source and the resistive element are coupled to the output terminal by means of a buffer circuit.

8. A band-gap reference circuit as claimed in claim 7, characterized in that the buffer circuit comprises a differential pair having a first input coupled to the current source and the resistive element, having a second input coupled to the output terminal, having a common terminal coupled to the first supply voltage terminal by means of a tail current source, having a first output coupled both to the second supply voltage terminal by means of a load element and to a control electrode of an output transistor which has a main current path coupled between the second supply voltage terminal and the output terminal, and having a second output coupled to the second supply voltage terminal.

* * * * *